United States Patent [19]

Snyder et al.

[11] 4,032,213

[45] June 28, 1977

[54] POLARIZING MEANS FOR ELECTRICAL CONNECTORS

[75] Inventors: Gene Larry Snyder, Bainbridge; David Thomas Braid, Rochester, both of N.Y.

[73] Assignee: The Bendix Corporation, Southfield, Mich.

[22] Filed: Jan. 29, 1976

[21] Appl. No.: 653,557

[52] U.S. Cl. ..... 339/186 M

[51] Int. Cl.² ..... H01R 13/64

[58] Field of Search ..... 339/184, 186

[56] References Cited

UNITED STATES PATENTS

| | | | |
|---|---|---|---|
| 2,857,570 | 10/1958 | Simpson | 339/184 R |
| 2,946,037 | 7/1960 | Platz et al. | 339/184 R X |
| 3,085,221 | 4/1963 | Kelly et al. | 339/186 M |
| 3,206,714 | 9/1965 | Kostich | 339/186 M |
| 3,426,315 | 2/1969 | De Tar | 339/184 M |
| 3,582,867 | 6/1971 | Thompson | 339/184 M |
| 3,611,272 | 10/1971 | Fairbairn | 339/184 M |
| 3,714,617 | 1/1973 | Bright et al. | 339/186 M |
| 3,864,005 | 2/1975 | Klein | 339/255 R |
| 3,944,316 | 3/1976 | Newman et al. | 339/186 R |

FOREIGN PATENTS OR APPLICATIONS

| | | | |
|---|---|---|---|
| 1,474,721 | 2/1967 | France | 339/184 M |
| 767,844 | 12/1957 | United Kingdom | 339/186 M |

*Primary Examiner*—Roy Lake
*Assistant Examiner*—Neil Abrams
*Attorney, Agent, or Firm*—S. H. Hartz; R. J. Eifler; K. A. Seaman

[57] ABSTRACT

A pair of mateable units with polarizing means for controlling mateability of the units comprising a member rotatably mounted on each of the units one of the members having an extension of predetermined shape and the other member having a recess of predetermined complementary shape for receiving the extension on the one member. The members each have a slot in one end for receiving a screw driver to rotate the members to adjusted position without removing, resetting and reassembling small components.

8 Claims, 5 Drawing Figures

POLARIZING MEANS FOR ELECTRICAL CONNECTORS

The invention relates to polarizing means for selectively matching separable, mateable parts, such as a connector plug and receptacle.

PRIOR ART

Separable electrical connectors are employed in computer and control installations where receptacle connector parts are mounted on a panel adjacent to each other and the mating connector parts are connected to respective flexible cables. Unless the connector parts are correctly mated malfunctioning or severe electrical damage to the apparatus may result. The polarizing means prevents incorrect mating of the several parts of the connectors.

Polarizing means for mating connector parts are shown in U.S. Pat. Nos. 3,582,867 and 3,611,272 assigned to the same assignee as the present application. The polarizing means described therein consists of a plurality of plug-like inserts which are seated in recesses in the bodies of the connectors. The recesses and inserts are constructed so that the inserts may be selectively disposed in a plurality of different positions in the recesses. This requires that the inserts be removed from the recesses and be angularly indexed and reinserted in the recesses.

The polarizing inserts of mated parts are shaped to complement and mate with each other when the inserts are correctly oriented or indexed in the recesses. If any one insert is not in a complementary position relative to its mate intereference results and prevents coupling the connector parts.

The polarizing means as used heretofore requires removal and reinsertion of the inserts in the recesses. Polarizing these devices is time consuming and due to the small size of the inserts creates handling problems which may result in mismating the polarizing means.

SUMMARY OF THE INVENTION

The present invention overcomes the problem of removing and reinserting the small inserts and the associated handling problems. Polarizing the mateable parts requires only a screw driver for rotating the inserts without disassembly and is accomplished in a fraction of the time needed for polarizing means as presently used.

The invention contemplates a device having a pair of mateable units and polarizing means for controlling mateability of the units, comprising a member rotatably mounted on each of said units, one of said members having an extension with a predetermined shape and the other member having a recess with a predetermined complementary shape for receiving the extension on the one member, and means providing for rotating the members from a position exteriorly of the units for polarizing the units.

The polarizing members are maintained in adjusted position by opposing serrations on each unit and associated member and a spring yieldably urges the serrations into engagement with one another. A slot is provided in one end of each member for a screw driver to move the members axially for disengaging the serrations and to rotate the members to adjusted position.

DRAWINGS

FIG. 1 is a vertical section showing an electrical connector prior to assembly with polarizing means constructed in accordance with the invention, the section being taken approximately on the lines 1—1 of FIG. 2, FIG. 2 is a section taken approximately on the lines 2—2 of FIG. 1, FIGS. 3 and 4 are partial end views showing the polarizing means, and FIG. 5 shows end views of the complementary mating elements of the polarizing means.

DETAILED DESCRIPTION OF THE INVENTION

Figure 1:
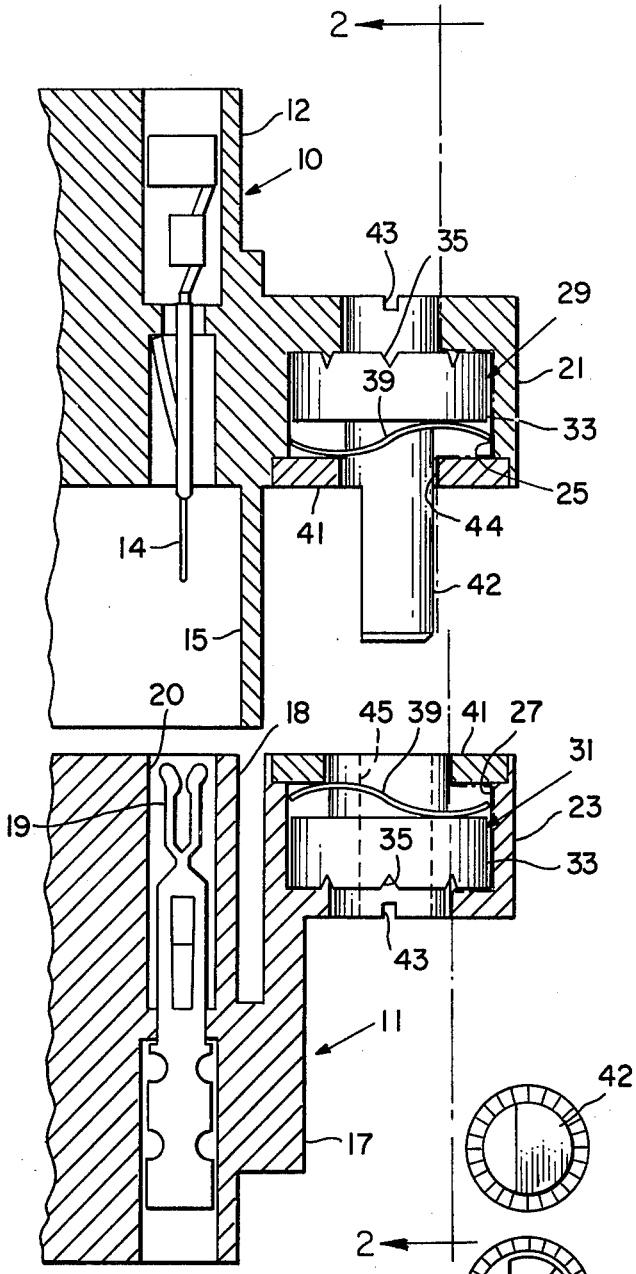
Figure 5:
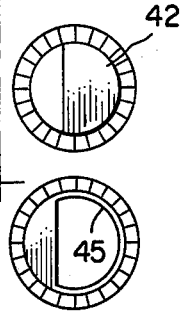
Figure 3:
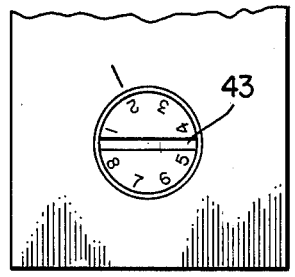
Figure 2:
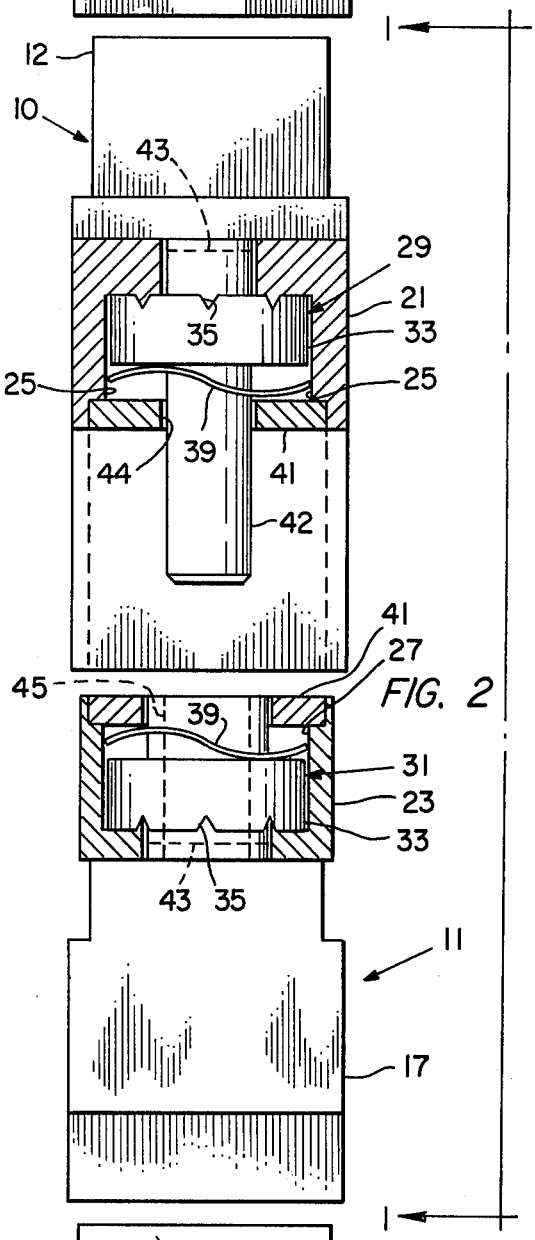
Figure 4:
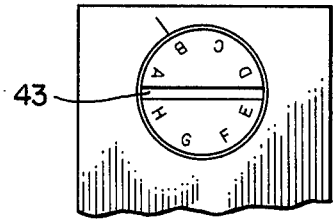

Referring to the drawing, the novel connector shown therein comprises a receptacle 10 and a plug 11 separably mateable with each other. Receptacle 10 includes a body 12 of rigid insulating material in which a plurality of pin contacts 14 are mounted in any suitable manner. Pin contacts 14 extend into a cavity 15 in one face of body 12.

Plug 11 similarly includes a body 17 of rigid insulating material with an outwardly extending portion 18 which fits within cavity 15 of the receptacle. A plurality of socket contacts 19 are suitably mounted in body 17 and extend into apertures 20. Socket contacts 19 receive pin contacts 14 when receptacle 10 and plug 11 are assembled.

Receptacle 10 and plug 11 have shoulders 21 and 23, respectively, extending therefrom and the shoulders 21 and 23 have bores 25 and 27, respectively, in registry with one another. The novel polarizing means for distinguishing one receptacle 10 and plug 11 from otherwise similar to identical receptacles and plugs includes a pair of circular members 29 and 31 rotatable and axially moveable in bores 25 and 27, respectively. The members each have a circumferential flange 33 with radial serrations 35 on one surface which mesh with corresponding serrations on an opposing face of the bore. A wave spring 39 encircles each circular member 29 and 31 and is positioned in the bore between flange 33 and a retaining ring 41 secured to each shoulder 21 and 23. The springs urge the circular members in a direction so that the serrations on the circular members mesh with the serrations on the opposing faces of the bores to prevent rotation of the members. A radial slot 43 is provided in the exposed end of each circular member for receiving a screw driver so that the member can be rotated by moving it axially in the bore against the force of spring 39 to disengage the serrations.

Circular member 29 on receptacle 10 has an elongated axial portion 42 which extends through an aperture 44 in the associated retaining ring 41 and circular member 31 on plug 11 has a complementary axial recess 45 for receiving portion 42 when receptacle 10 and plug 11 are assembled. The members are readily polarized and only a screw driver is required. The screw driver is inserted in slot 43 and the circular member is moved axially in opposition to spring 39 to disengage the serrations 35 and the member is rotated to the desired position. Indicia, such as alphabetic and numeric, are provided on the exposed ends of the members adjacent the slots to designate the positions of the members. The members can be polarized almost instantaneously without removing, resetting and reassembling small components.

What is claimed is:

1. A pair of mated electrical connectors comprising:
a housing associated with each connector, each housing having a mating face and an external face;
an oriented polarizing element extending from the mating surface of one housing and engaging in a mated relationship a polarizing element extending from the mating surface of the other housing, each polarizing member having an orientation with respect to each housing;
means for changing the orientation of the polarizing elements on the mated electrical connectors to various predetermined positions while the connectors and polarizing elements remain mated, said changing means comprising:
a member carried on at least one of the polarizing elements which extends through the external surface of the housing carrying the polarizing element, and which carries means for reorienting the mated polarizing elements by rotation thereof between said various predetermined positions, whereby the orientation of the polarizing elements on the mated electrical connectors may be changed with respect to each housing without unmating the pair of connectors.

2. An electrical connector comprising:
a housing having a front face and an axial passage extending therethrough;
electrical contacts mounted to the housing and facing in the same direction as the front face of the housing;
an oriented polarizing member having a rear portion and a forward polarizing portion facing in the same direction as the front face of the housing; and
means for mounting the polarizing member within said housing passage for axial movement between a first axial position and a second axial position and for rotational movement when said member is in said second axial position, said mounting means comprising:
means for biasing the polarizing member with a first axial force in a first axial direction and for positioning said polarizing member in the first axial position;
means for preventing rotational movement of the polarizing member while the polarizing member is in said first axial position, said preventing means allowing rotational movement of the polarizing member when the polarizing member is in said second axial position; and
means carried on said rear portion of the polarizing member for receiving a second axial force, directed oppositely of the first axial force, to move the polarizing member axial forward from said first axial position to said second axial position, and for receiving a rotational force to rotate and thereby reorient said member when said member is in said second axial position; whereby when said second axial force is applied to the polarizing member, the polarizing member moves axially forward from the first position to the second position, whereby when a rotational force is applied to said polarizing member, said member may be rotated and thereby reoriented while said polarizing member remains mounted to the housing and whereby when said second axial force is removed, said biasing means returns said polarizing member rearward to said first axial position where further rotation of the polarizing member is prevented.

3. An electrical connector of the type described in claim 2 wherein the means preventing rotational movement comprise serrations carried on one of the polarizing member and housing and a complementary surface on the other of the polarizing member and housing.

4. An electrical connector of the type described in claim 3 wherein the biasing means comprises a spring engaging a porton of the polarizing member for urging the serrations into the complementary surface in the first axial position.

5. An electrical connector of the type described in claim 2 wherein the biasing means comprises a wave washer exerting the first axial force on the polarizing member for positioning the member in the first axial position when the second axial force is not present.

6. An electrical connector of the type described in claim 5 wherein the means for receiving a rotational force comprises a slot.

7. A mateable electrical connector comprising:
a housing having a front face, a rear face and an axial passage extending through the housing with openings in the front and rear faces, said passage including a forwardly facing shoulder and a rearwardly facing shoulder;
electrical contacts mounted to the housing and facing in the direction of the front face of the housing;
a polarizing member having a forward polarizing portion, a rear portion and an enlarged middle portion having a forwardly facing shoulder and a rearwardly facing shoulder; and
means for mounting the polarizing member in said housing passage for axial movement between a first axial position and a second axial position and for rotational movement when said member is in said second axial position, said polarizing member disposed in said passage with its forward polarizing portion extending from the front face of the housing and its rear portion adapted to receive an axial force, said means comprising:
means for biasing the polarizing member in a first axial direction in the housing passage to locate said polarizing member in the first axial position, said biasing means engaging one of said passage shoulders and one of said shoulders of the enlarged portion of said polarizing member to urge the other shoulder of the enlarged portion against the other of said passage shoulders, thereby captivating the enlarged portion of the polarizing member within said housing passage;
means carried on said other shoulder of said enlarged portion of said member and said other passage shoulder for preventing the polarizing member for rotational movement while the polarizing element is in the first position; and
means carried on the rear portion of said polarizing member for receiving a rotational force to rotate the polarizing member and thereby obtain a reorientation thereof when the polarizing member is in the second position;
whereby an axial force applied to the rear portion of the polarizing member moves the polarizing member axially against the urging of the biasing means from the first axial position where rotational movement of the member is prevented to the second axial position where the polarizing member may be reoriented by a rotational force on the rear portion of the polarizing member to obtain a reorientation of the polarizing member while the member remains connected to the housing, and whereby the biasing means returns the polarizing member to the first axial position where rotational movement of the polarizing member is prevented when the axial force is not applied to the rear portion of the polarizing member.

8. An electrical connector as described in claim 7 wherein the biasing means comprises a spring and the means preventing rotational movement of the polarizing member comprises a set of serrations on the other shoulder of the enlarged portion and a complementary surface on the other of said passage shoulders, with the spring biasing the set of serrations into contact with the complementary surface to prevent rotational movement of the polarizing member.

* * * * *

UNITED STATES PATENT AND TRADEMARK OFFICE

CERTIFICATE OF CORRECTION

PATENT NO. : 4,032,213

DATED :July 18, 1977

INVENTOR(S) :GENE LARRY SNYDER, DAVID THOMAS BRAID

It is certified that error appears in the above-identified patent and that said Letters Patent are hereby corrected as shown below:

Column 4, Line 55, change "for" to --from--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*